United States Patent [19]

Tanno et al.

[11] Patent Number: 4,900,355

[45] Date of Patent: Feb. 13, 1990

[54] METHOD FOR MAKING HIGH-PURITY METAL POWDER BY JET-COOLING

[75] Inventors: Koichi Tanno; Masaaki Yagi, both of Sendai, Japan

[73] Assignee: Miyagi National College of Technology, Natori, Japan

[21] Appl. No.: 309,727

[22] PCT Filed: May 25, 1988

[86] PCT No.: PCT/JP88/00504

§ 371 Date: Jan. 19, 1989

§ 102(e) Date: Jan. 19, 1989

[30] Foreign Application Priority Data

Nov. 30, 1987 [JP] Japan ..... 62-299900

[51] Int. Cl.[4] ..... B22F 1/00

[52] U.S. Cl. ..... 75/0.5 C

[58] Field of Search ..... 75/0.5 C; 264/8, 10; 425/8

[56] References Cited

FOREIGN PATENT DOCUMENTS 40-275521 12/1965 Japan .
61-91302 5/1986 Japan .
62-47415 3/1987 Japan .

*Primary Examiner*—L. Dewayne Rutledge
*Assistant Examiner*—David W. Schumaker
*Attorney, Agent, or Firm*—Stevens, Davis, Miller & Mosher

[57] ABSTRACT

A dry method for making high-purity metal powder through quenching, by melting metal in a melting vessel with high-frequency induction in vacuo or in an inert gas atmosphere, lowering the melting vessel to a jetting position where a rotary cooling board is disposed along outer periphery of the melting vessel, centrifugally jetting the molten metal from the melting vessel by rotating the melting vessel in a direction while rotating the rotary cooling board in the opposite direction, and simultaneously quenching and splitting centrifugally jetted molten particles of the metal by causing the molten particles to collide with the rotary cooling board.

According to the method of the invention, an inverse T-shaped melting vessel with nozzles and a rotary cooling board are rotated in opposite directions in vacuo or in an inert gas atmosphere so as to jet molten metal droplets centrifugally from the melting vessel for producing powder particles of the metal by collision of the molten metal droplets with the cooling board rotating in the opposite direction, so that the average diameter of the metal powder particles thus produced can be adjusted freely by adjusting the ratio of the rotating speeds of the melting vessel and the rotary cooling board, and the powder particles thus produced have a uniform distribution of grain size and are free from both gaseous inclusion and secondary particle adhesion.

1 Claim, 2 Drawing Sheets

METHOD FOR MAKING HIGH-PURITY METAL POWDER BY JET-COOLING

TECHNICAL FIELD

This invention relates to a method of making metal powder, and more particularly to a method of making high-purity fine metal powder through a dry process by forming fine molten droplets of the metal with centrifugal force and quenching the fine molten droplets by their collision with a rotary cooling board.

BACKGROUND ART

Heretofore, several methods have been known for making metal powder directly from a melt of the metal by using rotation; such as a method in which a melt of metal in a fixed crucible is dropped through a nozzle bored at its lower portion toward the central portion of a rotary disk so that the molten metal is centrifugally dispersed and formed into powder particles, a method that uses a specimen rod of metal as an electrode so as to melt a part of it with a plasma arc or the like while rotating it so as to disperse the molten metal for producing the metal powder particles, and a method of forming metal powder particles by jetting melt of the metal into a rotating liquid coolant for causing collision of the jetted melt with the coolant.

In the first two methods using the rotary disk and the rotating electrodes, respectively, an annular belt of the melt is centrifugally formed on the rotary disk or the outer surface of the revolving metal rod, and metallic droplets are dispersed from the annular belt of the melt. Thus, a very high revolving speed is required in order to produce minute droplets. Accordingly, the conventional methods have shortcomings in that minute powder particles are difficult to produce because the revolving speed of the rotary disk and the revolving rod is limited from the standpoint of the safety of rotating device, and that, when the coolant is an inert gas, its cooling speed is not so high and a long flying distance is required for the droplets to solidify, and the apparatus for making the metal powder tends to become large and deposition of the powder metal on the apparatus wall tends to increase. A method, in which melt of metal in a fixed crucible is jetted in an atomized fashion by gas pressure into a rotary drum containing water, has excellent property in producing fine powder particles but has a shortcoming in that the surface of powder particles tends to be contaminated by the liquid coolant and a large amount of powder particle deposit on the outer wall.

There is a method in which a melting vessel and a liquid coolant tank are rotated simultaneously while allowing variation of the revolving speed ratio thereof and changing of the revolving directions, and the melt in the melting vessel is jetted centrifugally into the liquid coolant in the cooling tank so as to produce metal powder particles. Such a method also has excellent property in producing fine powder particles but has shortcomings in that contamination of the powder particles cannot be avoided and that it is not suitable for metals with a high melting point.

DISCLOSURE OF THE INVENTION

An object of the invention is to solve the above-mentioned shortcomings of the conventional methods by providing a method for producing high-purity fine spherical metal powder by causing collision of centrifugally atomized droplets of molten metal with rotary cooling board for quenching into solid powder particles.

A method according to the present invention comprises steps of melting metal by high-frequency induction, lowering the melting vessel to a jetting position where a rotary cooling board is disposed along outer periphery of the melting vessel, centrifugally jetting the molten metal from the melting vessel by rotating the melting vessel in a direction while rotating the rotary cooling board in an opposite direction, and simultaneously quenching and splitting the centrifugally jetted molten metal droplets by causing the molten metal droplets to collide with the rotary cooling board, said steps from the melting of metal to the simultaneous quenching and splitting being effected in vacuo or in an inert gas atmosphere.

BRIEF DESCRIPTION OF THE DRAWINGS

The accompanying drawings illustrate an apparatus for effecting an embodiment of the method of making high-purity metal powder by jet quenching according to the invention, in which.

Figure 1:
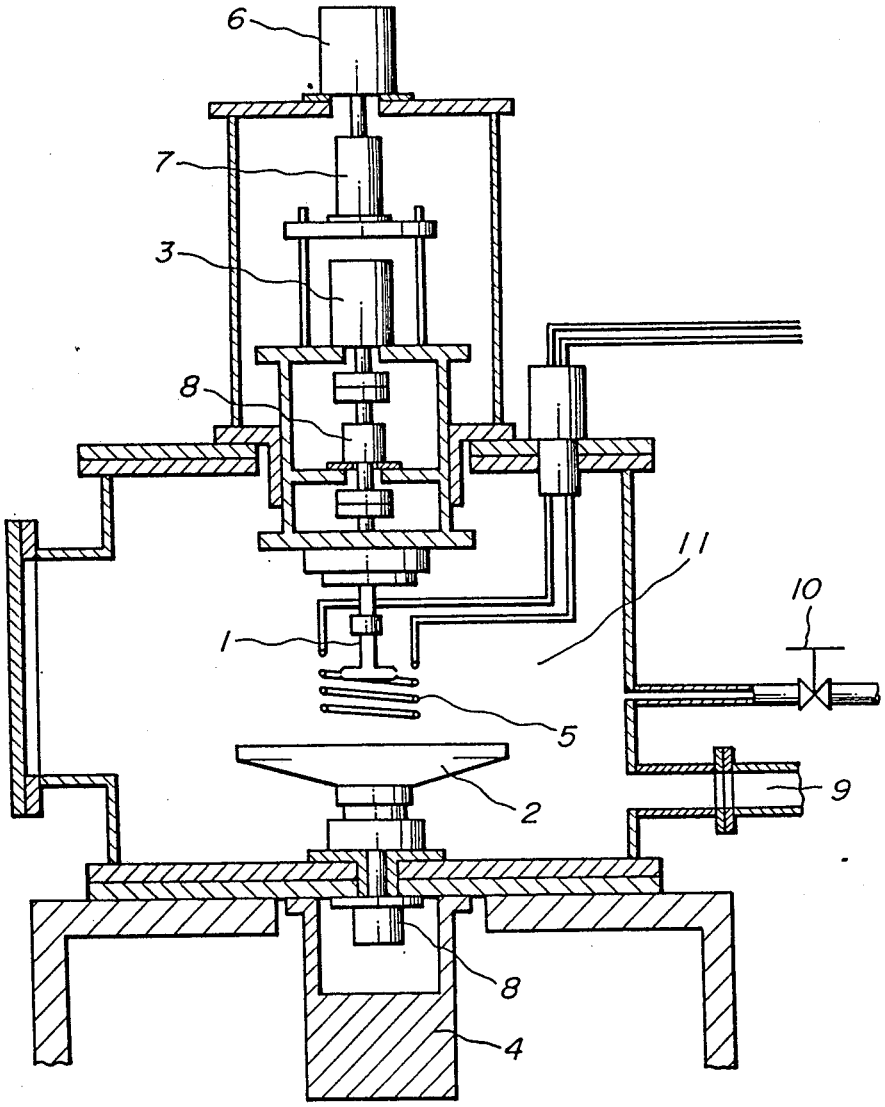
FIG. 1 is a partially cutaway overall side view of the apparatus.

In the drawings, 1 is a crucible, 2 is a cooling board, 3, 4 are high-speed driving motors, 5 is an induction coil, 6 is an air cylinder, 7 is a positioning screw, 8 is a magnetic seal, 9 is a gas outlet, 10 is a gas inlet, 11 is a chamber, and 12 is an orifice.

THE BEST MODE FOR CARRYING OUT THE INVENTION

An embodiment of apparatus for carrying out the method of making metal powder according to the present invention will now be described in detail by referring to the overall view of FIG. 1 and expanded sectional views of a melting portion and a cooling board of FIG. 2.

Figure 2:
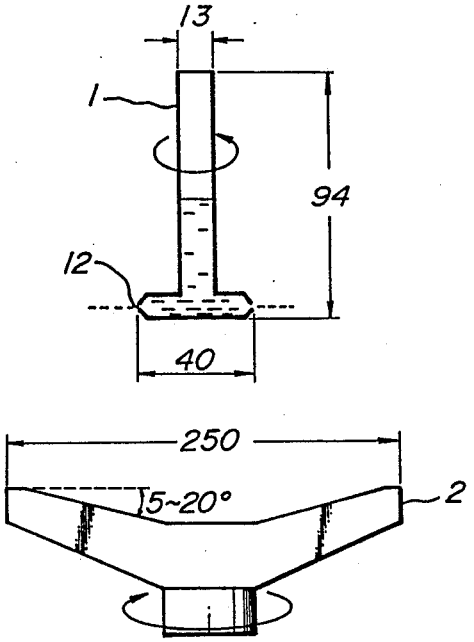
FIG. 2 is an expanded views of a crucible and a cooling board of the apparatus.

A melting crucible 1 is for melting and jetting of material metal, and it has an inverse T-shaped cross-section and orifices 12 or jet nozzles are formed on opposite ends of the bottom part thereof as shown in FIG. 2. To split droplets jetted from the crucible 1 and to quench them simultaneously, a cooling board 2 is disposed below the crucible 1. The cooling board 2 is of shallow mortar shape, and the inside surface of its side wall is inclined by an angle of 5°–20° relative to a horizontal. High-speed driving motors 3 and 4 rotate the crucible 1 and the cooling board 2, respectively, and each of such driving motors has a built-in reduction gear. The metal in the crucible 1 is heated and melted by an induction coil 5. An air cylinder 6 vertically moves the crucible 1 between a melting position and a jetting position. The jetting position of the crucible 1 can be adjusted accurately by a positioning screw 7. The process of making metal powder is effected within a chamber 11 which is sealed by a magnetic seal 8. The inside space of the chamber 11 can be selectively kept either as vacuum or as an inert gas atmosphere.

With the above described apparatus, the crucible 1 with metal material sealed therein is placed within and heated by the high-frequency induction coil 5 in vacuo or in an inert gas atmosphere. After the melting, the cooling disk or board 2 is rotated and the crucible 1 is lowered to its jetting position, and while it is rotated in a direction opposite to the rotation of the cooling board 2 the molten metal is jetted from the jet nozzles or orifices 12. With the increase of the revolving speed, the diameter of the metal powder becomes smaller, and the mean diameter of the metal powder can be controlled at will by adjusting the revolving speed. Thereby, highly pure metal powder can be produced at a high cooling rate.

EXAMPLE

An example of metal powder production by the method of the invention will now be described. When $Fe_{82}$-$B_{18}$ alloy was processed into powder by the above described apparatus, in which the diameter of the orifice or jetting nozzle 12 was 0.3 mm and the cooling disk or board 2 was made of copper and the revolving speeds of the crucible 1 and the cooling board 2 were both about 10,000 rpm, spherical metal powder particles with an average diameter of about 15 μm were obtained.

The metal powder particles thus obtained had a spherical shape with a smooth surface and there were very little deposition of secondary particles. Besides, part of the minute powder particles were found to be amorphous, so that excellent quenching or quick-cooling effect was proved. Similar effects were confirmed by tests using super-alloy powder and Zn powder.

CAPABILITY OF EXPLOITATION IN INDUSTRY

As described in detail in the foregoing, a method of the invention produces metal powder in vacuo or in an inert gas atmosphere while using a combination of rotations of an inverse T-shaped nozzle and a cooling board, and it has the following outstanding effects which could not be achieved by the prior art.

(1) Average diameter of metal powder particles can be controlled by adjusting the revolving speeds of the melting vessel and the cooling board which turn simultaneously in opposite directions.

(2) Metal with a high melting point can be powdered, because the metal is molten by high-frequency induction and the molten metal is jetted by centrifugal force. Besides, the method can produce metal powder free from gas inclusion.

(3) Metal powder particles free from deposition of secondary particles and having a narrow grain size distribution can be produced with good effects of quick-cooling, because the molten metal is jetted through orifices bored on the melting crucible and the jetted molten metal is cooled by a rotary cooling board.

We claim:

1. A method of making high-purity metal powder by jet-quenching, comprising steps of melting metal in a melting vessel by high-frequency induction, lowering the melting vessel to a jetting position where a rotary cooling board is disposed along outer periphery of the melting vessel, centrifugally jetting the molten metal from the melting vessel by rotating the melting vessel in a direction while rotating the rotary cooling board in an opposite direction, and simultaneously quenching and splitting the centrifugally jetted molten metal droplets by causing the molten metal droplets to collide with the rotary cooling board, said steps from the melting of metal to the simultaneous quenching and splitting being effected in vacuo or in an inert gas atmosphere.

* * * * *